US006463708B1

(12) United States Patent
Anderson

(10) Patent No.: US 6,463,708 B1
(45) Date of Patent: Oct. 15, 2002

(54) ROOF SHINGLE AND SYSTEM

(76) Inventor: Victor W. Anderson, 13222 N. 37th Pl., Phoenix, AZ (US) 85032

( * ) Notice: Subject to any disclaimer, the term of this patent is extended or adjusted under 35 U.S.C. 154(b) by 0 days.

(21) Appl. No.: 09/440,381

(22) Filed: Nov. 15, 1999

(51) Int. Cl.[7] ..... E04D 1/00
(52) U.S. Cl. ..... 52/521; 52/520; 52/526; 52/530; 52/535; 52/549; 52/551; 52/552; 52/554
(58) Field of Search ..... 52/520, 521, 526, 52/530, 535, 549, 551, 552, 554

(56) References Cited

U.S. PATENT DOCUMENTS

| | | | |
|---|---|---|---|
| 3,953,946 | A | 5/1976 | Peters et al. |
| 3,977,141 | A | 8/1976 | Peters |
| 4,001,997 | A | 1/1977 | Saltzman |
| 4,010,590 | A | 3/1977 | Reinke |
| 4,015,391 | A | 4/1977 | Epstein et al. |
| 4,021,981 | A | 5/1977 | Van Wagoner |
| 4,096,679 | A | 6/1978 | Naz |
| 4,107,885 | A | 8/1978 | Lindal |
| 4,120,132 | A | 10/1978 | Kendrick |
| 4,187,661 | A | 2/1980 | Poiry |
| 4,195,455 | A | 4/1980 | Chalmers et al. |
| 4,218,857 | A | 8/1980 | Vallee |
| 4,223,490 | A | 9/1980 | Medow |
| 4,233,795 | A | 11/1980 | Snyder et al. |
| 4,251,967 | A | 2/1981 | Hoofe, III. |
| 4,271,652 | A | 6/1981 | Svensson |
| 4,283,897 | A | 8/1981 | Thompson |
| 4,288,951 | A | 9/1981 | Carlson et al. |
| 4,288,958 | A | 9/1981 | Chalmers et al. |
| 4,292,776 | A | 10/1981 | MacDonald |
| 4,292,781 | A | 10/1981 | Chalmers et al. |
| 4,325,290 | A | 4/1982 | Wolfert |
| 4,356,673 | A | 11/1982 | Gailey |
| 4,382,354 | A | 5/1983 | Gailey et al. |
| 4,406,095 | A | 9/1983 | Slavik |

(List continued on next page.)

OTHER PUBLICATIONS

Product brochure bearing notice "Copyright 1995 Boral Industries" with color photographs labeled "Two–Piece El Camino Blend, A beautiful Caliente™ Series blend, ranging from terracotta to shades of mocha brown and gray" and "Two–Piece De Anza Blend, A unique mixture of El Camino Blend, the red and brown hues of Fire Flash and an apricot accent of Mallorca."

(List continued on next page.)

*Primary Examiner*—Carl D. Friedman
*Assistant Examiner*—Chi Q. Nguyen
(74) *Attorney, Agent, or Firm*—Edwin A. Suominen; Louis J. Hoffman

(57) ABSTRACT

A roofing system includes first and second pluralities of shingles, which include central planar portions. Shingles of each plurality are arranged such that their respective central planar portions are substantially co-planar. Each shingle of the first plurality is adjacent at least one shingle of the second plurality. The central planar portions of shingles of the first plurality are displaced with respect to central planar portions of shingles of the second plurality by a separation distance. Adjacent shingles may be installed such that opposite surfaces of their central planar portions are exposed to view. A surfacing shingle may include a central planar portion and several edge portions. The shingles may be used in a ventilated roofing system, which includes a surfacing structure coupled to a roofing substrate. The surfacing structure is elevated with respect to the substrate such that an airspace is disposed between the substrate and the underside of the surfacing structure. The airspace is made accessible to both first and second portions of the substrate. The ventilated system further includes a first ventilation port at the first portion of the substrate for coupling the airspace to the exterior of the roofing system and a second ventilation port at the second portion of the substrate for coupling the airspace to the exterior of the roofing system.

31 Claims, 10 Drawing Sheets

U.S. PATENT DOCUMENTS

| | | | | | |
|---|---|---|---|---|---|
| 4,411,120 | A | | 10/1983 | Ellis et al. | |
| 4,423,572 | A | | 1/1984 | Tor | |
| 4,459,788 | A | | 7/1984 | Bockwinkel et al. | |
| 4,476,661 | A | | 10/1984 | Hoofe, III | |
| 4,489,532 | A | | 12/1984 | Ellis et al. | |
| 4,601,135 | A | | 7/1986 | Ellis et al. | |
| 4,731,970 | A | | 3/1988 | Marshall et al. | |
| 4,759,165 | A | | 7/1988 | Getoor et al. | |
| 4,762,053 | A | | 8/1988 | Wolfert | |
| 4,776,262 | A | | 10/1988 | Curran | |
| 4,876,950 | A | | 10/1989 | Rudeen | |
| 4,995,308 | A | | 2/1991 | Waggoner | |
| 5,122,095 | A | | 6/1992 | Wolfert | |
| 5,349,801 | A | | 9/1994 | Verbofsky | |
| 5,352,154 | A | | 10/1994 | Rotter et al. | |
| 5,361,551 | A | | 11/1994 | Post | |
| 5,402,611 | A | | 4/1995 | Vagedes | |
| 5,425,672 | A | | 6/1995 | Rotter | |
| 5,437,735 | A | | 8/1995 | Younan et al. | |
| 5,442,888 | A | | 8/1995 | Ilnyckyj | |
| 5,455,099 | A | | 10/1995 | Banner | |
| 5,457,920 | A | | 10/1995 | Waltz | |
| 5,469,680 | A | * | 11/1995 | Hunt | 52/520 |
| 5,495,654 | A | | 3/1996 | Goodhart et al. | |
| 5,537,792 | A | | 7/1996 | Moliere | |
| 5,613,337 | A | | 3/1997 | Plath et al. | |
| 5,657,603 | A | | 8/1997 | Goodhart et al. | |
| 5,685,117 | A | | 11/1997 | Nicholson | |
| 5,694,728 | A | | 12/1997 | Heath, Jr. et al. | |
| 5,711,127 | A | * | 1/1998 | Sabourin | 52/530 |
| 5,718,086 | A | | 2/1998 | Dunn | |
| 5,737,881 | A | | 4/1998 | Stocksieker | |
| 5,784,848 | A | | 7/1998 | Toscano | |
| 5,826,383 | A | | 10/1998 | Garrison | |
| 5,881,501 | A | | 3/1999 | Guffey et al. | |
| 5,890,327 | A | | 4/1999 | Merser et al. | |
| 5,916,103 | A | | 6/1999 | Roberts | |
| 5,918,425 | A | | 7/1999 | Archard et al. | |
| 5,921,863 | A | | 7/1999 | Sells | |
| 5,924,925 | A | | 7/1999 | Nystrom | |
| 5,934,995 | A | | 8/1999 | Morris et al. | |
| 5,937,592 | A | | 8/1999 | Tamlyn | |
| 5,941,028 | A | | 8/1999 | Hicks | |
| 5,946,868 | A | | 9/1999 | Morris | |
| 5,956,913 | A | * | 9/1999 | Nicholson | 52/520 |
| 6,014,847 | A | * | 1/2000 | Phillips | 52/311.1 |

OTHER PUBLICATIONS

Product brochure bearing notice "Copyright 1995 Boral Industries" with color photographs labeled "One–Piece El Camino Blend, A beautiful Caliente™ Series blend, ranging from terracotta to shades of mocha brown and gray" and "One–Piece De Anza Blend, A unique mixture of El Camino Blend, the red and brown hues of Fire Flash and an apricot accent of Mallorca."

Product brochure bearing notice "Copyright 1995 Boral Industries" with color photographs labeled "Two–piece Durango Blend, A dark, coffee–bean brown with subtle variations in shading" and "Two Piece Old World Blend, A blend of three distinct browns, with subtle variations of shading within each."

Product brochure bearing notice "Copyright 1995 Boral Industries" with color photographs labeled "One–Piece Durango Blend, A dark coffee–bean brown with subtle variations in shading" and "One Piece Old World Blend, A blend of three distinct browns, with subtle variations of shading within each."

Web page printed on Sep. 18, 1999 from Internet domain http://www.unaclad.com entitled "Copper Sales product database–Roofing system: UC–700."

Web pages printed on Aug. 31, 1999, from Internet domain http://www.rooftiles.co.uk entitled "Roof Ventilation," pp. 1–7.

Product brochure bearing notice "©Air Vent Inc. 1992" entitled "Proven Performance Through Research," reproduced on four color copy sheets.

Product brochure bearing notice "©BHP Steel Building Steel Products USA Inc. Nov. 1997" entitled "HR–36." (Two–sided.).

Product brochure bearing notice "©BHP Steel Building Steels Products USA Inc. Mar. 1998" entitled "C&Z Structural Sections." (Two–sided.).

* cited by examiner

ROOF SHINGLE AND SYSTEM

BACKGROUND OF THE INVENTION

Metal shingles are considered desirable in many roofing installations due to their longevity and distinctive appearance. However, shingles made of bulk materials have inherent thickness not possessed by sheet metal. This thickness has made bulk shingles more desirable in some respects than conventional metal shingles. As used herein, the term "bulk materials" refers to materials used in conventional shingles that have inherent thickness. The term "bulk shingles" refers to shingles fabricated with bulk materials. Examples of bulk materials are ceramic tile, asphalt, wood shake, and foamed plastic.

Because bulk shingles are fabricated from material that is thicker than the sheet metal used in metal shingles, they have a higher thermal resistance than conventional metal shingles. In addition, bulk materials typically have higher thermal resistance per unit thickness than metal. It is known to include a sheet of bulk material (e.g., foamed plastic material) in the central planar portion of a metal shingle to improve its thermal resistance, effectively creating a bulk shingle. Such an arrangement is disclosed, for example, in U.S. Pat. No 5,442,888 to Ilnyckyj. However, there remains a need for a metal-shingle roofing system having improved insulation value without the requirement for additional materials.

The thickness of bulk shingles can impart a texture to the roofing system in which they are installed. When courses of bulk shingles are allowed to overlap, some shingles in the roofing system are raised with respect to others. Depending on the angle of light, the raised shingles can cast shadows on adjacent shingles. This shadowing and the textured pattern provided by raised and lowered shingles results in an appearance that many consider attractive.

The sheet of foamed plastic material disclosed in U.S. Pat. No. 5,442,888 to Ilnyckyj imparts an appearance of thickness to the shingle to which it is adhered. A roofing system using such a shingle may have some textured appearance. The need remains, however, for a metal shingle having an appearance of thickness without the requirement for its central planar portion to be given bulk thickness by the inclusion of additional materials. A further need remains for a roofing system having a textured appearance beyond that obtained by the conventional stacking of overlapping shingles.

A further need remains for a metal shingle that may be used in a radiused roofing system. Radiused roofing systems are used in conjunction with curved walls. Because courses of shingles cannot be laid out in straight lines in a radiused roofing system, conventional interconnected metal shingles are difficult to use in such a system.

The need also remains to provide ventilation under the surface of a metal roofing system. In conventional metal roofing systems that are installed in hot and sunny climates, for example, metal shingles convert sunlight into heat, which raises the temperature of the roof substrate and thus contributes to cooling inefficiency. It is particularly desirable to provide ventilation below the surface of a metal roofing system. In conventional roofing systems, ventilation is provided in the attic space beneath the roof substrate. A number of ventilation holes, referred to as "soffit vents," are provided beneath the eaves of the roof. Cool air is drawn into the attic space to replace hot air, which exits the attic space through vents in the roof or sides of the structure supporting the roof. Although such an arrangement provides some exchange of air, additional ventilation would be desirable.

SUMMARY OF THE INVENTION

A roofing system according to various aspects of the present invention includes first and second pluralities of shingles. Each shingle includes a respective central planar portion. The shingles of each plurality are arranged such that their respective central planar portions are substantially co-planar. The first and second pluralities of shingles are arranged together such that: (1) each shingle of the first plurality is adjacent at least one shingle of the second plurality; and (2) the central planar portions of the shingles of the first plurality are displaced, with respect to the central planar portions of the shingles of the second plurality, by a separation distance. This displacement is along an axis perpendicular to the central planar portions of both pluralities of shingles. The separation distance is substantially greater than the thickness of the central planar portions of each shingle of both pluralities of shingles.

By displacing pluralities of adjacent shingles, such a roofing system provides a number of aesthetic and functional benefits. Such benefits include the availability of, inter alia, improved ventilation, textured appearance, and shadowing (under suitable lighting conditions).

A surfacing shingle according to various aspects of the present invention includes a central planar portion and several edge portions. The central planar portion has a first surface and a second surface opposite the first surface. The edge portions include: a first edge portion at a first edge of the central planar portion; a second edge portion at a second edge of the central planar portion; a third edge portion at a third edge of the central planar portion; and a fourth edge portion at a fourth edge of the central planar portion. The first, second, and third edge portions are each oriented at an acute angle with respect to the first surface. The fourth edge portion is oriented at an acute angle with respect to the second surface. The first and second edges of the central planar portion are opposite each other, as are the third and fourth edges.

Advantageously, such a shingle permits displacement by a separation distance that is substantially greater than the thickness of its central planar portion. Such a separation distance is highly significant because a roofing system using such shingles, according to aspects of the invention, may achieve a textured appearance and provide shadowing even when the central planar portions are free of bulk material. In addition, such shingles inherently provide a support structure for elevation of a surfacing structure from a substrate. The shingles thus cooperate to form an inherently supported surfacing structure in a ventilated roofing system according to further aspects of the invention.

By elevating a surfacing structure from a roofing substrate, thermal conductivity between the structure and substrate is reduced. Thus, thermal shock to a substrate from rapid heating and cooling of a surfacing structure (e.g., from changing levels of sunlight onto metallic shingles) is avoided.

A ventilated roofing system according to various aspects of the present invention includes a surfacing structure coupled to a roofing substrate. The surfacing structure, which may be comprised of interconnected shingles, is elevated with respect to the substrate such that an airspace is disposed between the substrate and the underside of the surfacing structure. The airspace is made accessible to both the first and second portions of the substrate. The system further includes a first ventilation port at the first portion of the substrate for coupling the airspace to the exterior of the roofing system; and a second ventilation port at the second portion of the substrate for coupling the airspace to the exterior of the roofing system.

Shingles may be installed onto a roofing substrate, according to a method of the invention, by (1) providing a plurality of like shingles, and (2) installing the plurality of shingles onto the substrate. Each shingle of the plurality includes a central planar portion that is fabricated of sheet material. Metal, particularly copper, is considered particularly advantageous for fabrication of the central planar portion. Each central planar portion has a respective first surface and a respective second surface opposite the first surface. The shingles are installed onto the substrate such that (1) a first shingle of the plurality is secured to the substrate with the first surface of its central planar portion facing upwards and away from the substrate; (2) a second shingle of the plurality is coupled to the first shingle, the second surface of the central planar portion of the second shingle facing upwards and away from the substrate; and (3) a third shingle of the plurality is coupled to the substrate and to the second shingle, the first surface of the central planar portion of the third shingle facing upwards and away from the substrate. The second shingle of the plurality may be coupled to the first and third shingles of the plurality prior to installation of the plurality of shingles onto the substrate.

BRIEF DESCRIPTION OF THE DRAWING

Various embodiments of the present invention are described below with reference to the drawing, wherein like designations denote like elements, and:

FIG. 5, including

DESCRIPTION OF PREFERRED EXEMPLARY EMBODIMENTS

Figure 1:
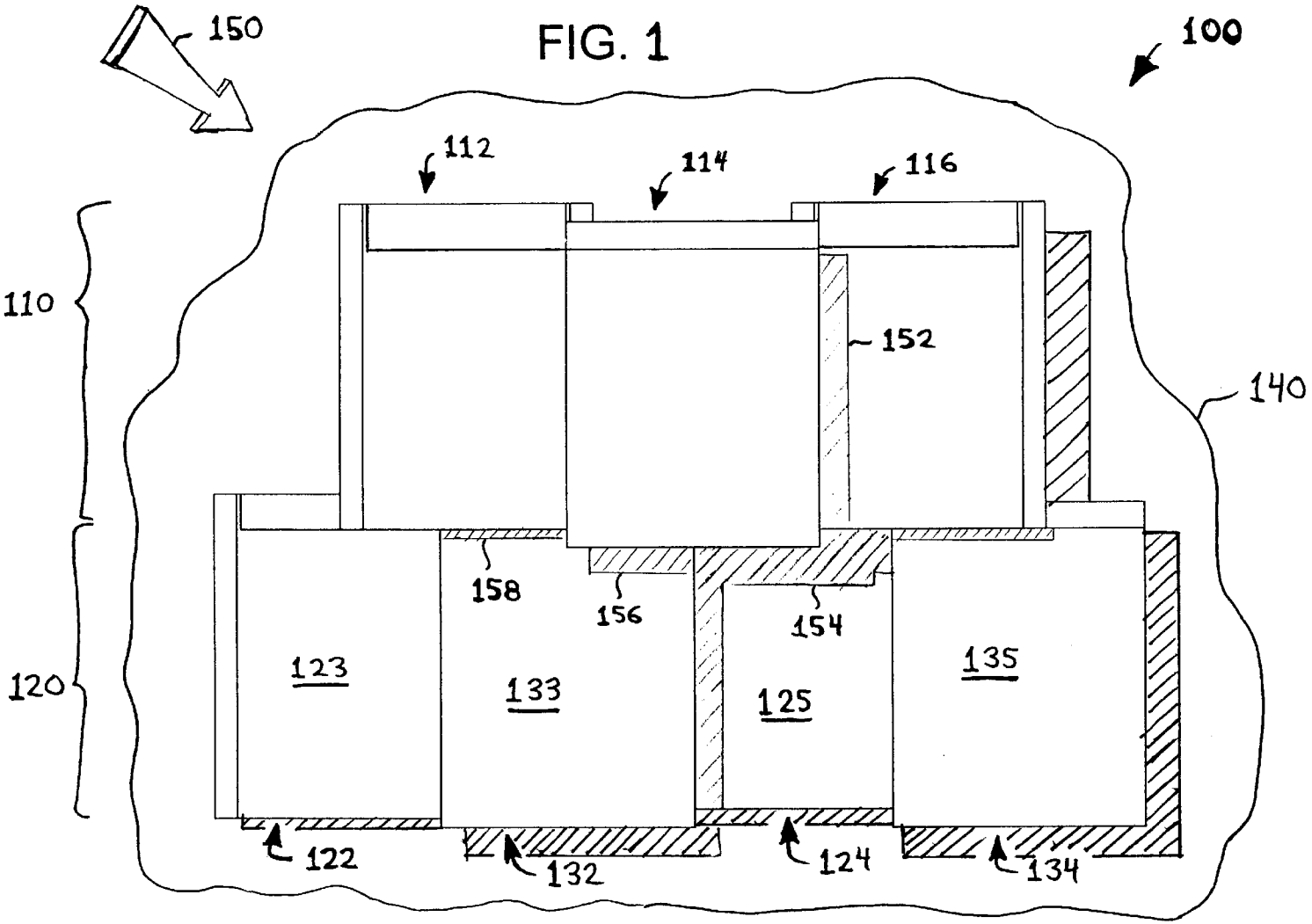
FIG. 1 is a top view of a roofing system according to various aspects of the present invention.

A roofing system according to various aspects of the present invention provides a number of aesthetic and functional benefits including the availability of, inter alia, improved ventilation, a textured appearance, and shadowing (under suitable lighting conditions). Advantageously, such a system is able to provide these benefits even when all of the shingles in the system are of the same form and dimensions. The system may include numerous courses of shingles. Each course of shingles in the system includes first and second pluralities of shingles. For example, exemplary roofing system 100 of FIG. 1 includes an upper course of shingles 110 and a lower course of shingles 120, arranged on a conventional roofing substrate 140. Upper course 110 includes shingles 112, 114, and 116. Lower course 120 includes a first plurality of shingles 122 and 124, and a second plurality of shingles 132 and 134. Substrate 140 may be comprised of any suitable material(s) for constructing a roof deck, for example ½ inch plywood sheathed with a conventional waterproof surfacing membrane. A suitable membrane may be fabricated from any suitable elastic, adhesive material that is conventionally used as an ice and water shield in a roofing system.

A shingle according to various aspects of the present invention includes any generally flat structure having a central planar portion for covering a substrate, e.g., roofing substrate, structure wall, etc.) The central planar portion of a shingle occupies most of its length and width. In a shingle that is constructed entirely of sheet material, the central planar portion is simply a flat portion of sheet material having opposing planar surfaces. In such a shingle, the thickness of the sheet material (i.e., the separation between the opposing planar surfaces) is significantly less than the width (and of course the length) of the shingle.

As discussed above, the shingle disclosed in U.S. Pat. No. 5,442,888 to Ilnyckyj has a central planar portion that includes bulk material. In contrast, a shingle fabricated from a single bent piece of sheet metal and having no bulk material adhered to it, according to one aspect of the present invention, has a central planar portion consisting entirely of sheet metal. The thickness of such a central planar portion is substantially less than the width of the shingle. As discussed below, for example, a metal shingle having a particularly distinctive appearance may be fabricated from a single piece of 20 oz. sheet copper.

As may be better understood with reference to FIG. 2, an exemplary shingle 122 includes central planar portion 123 as well as edge portions 220, 230, 240, and 250, which are described in greater detail below. Central planar portion 123 occupies nearly all of the exposed surface area of shingle 122 except the small areas covered by edge portions 220, 230, 240, and 250.

Each shingle in system 100 includes a respective central planar portion. Shingles 122 and 124 of the first plurality have respective central planar portions 123 and 125. Shingles 132 and 134 of the second plurality have respective central planar portions 133 and 135.

The central planar portions of shingles in a roofing system according to various aspects of the present invention may have differing widths, for example to achieve a desired aesthetic effect. (Preferably, the length of each shingle should be the same.) For example. shingles of a first plurality may be narrower than shingles of a second plurality. Several different shingle width may be employed to achieve a distinctive appearance. However, the central planar portions all have the same length. All shingles in exemplary system 100 have the same length and width, which simplifies installation. System 100 may be installed from a single common supply of like shingles.

Each shingle in system 100 (e.g., shingle 122) includes edge portions that partially cover up its central planar portion. Accordingly, the actual area of each central planar portions that is visible in the assembled roofing system can be expected to be smaller than the actual area of the central planar portions.

First and second pluralities of shingles, in a system according to various aspects of the present invention, may be arranged together in such a way as to provide particular advantages. For example, shingles of one plurality may be adjacent at least one shingle of the other plurality. By interspersing shingles of different pluralities, various patterns may be achieved. In exemplary system 100, shingles 122 and 124 of the first plurality are arranged adjacent shingle 132 of the second plurality. Shingles 132 and 134 of the second plurality are arranged adjacent shingle 124 of the first plurality.

The central planar portion of each shingle in system 100 has a first surface and a second surface opposite the first surface. (As discussed below with reference to FIG. 2, the first surface may be considered the surface facing most of the edge portions of a shingle, for example surface 210 of shingle 122.) The shingles in system 100 are arranged with respect to each other such that like surfaces of adjacent shingles face in opposite directions. For example, the first surface (according to the definition above) of shingle 122 faces upwards and away from substrate 140 while the first surface of adjacent shingle 132 faces downward and toward substrate 140. The first surface of shingle 122 is exposed to view, while the second surface of shingle 132 is exposed to view.

Exposing alternating surfaces of the central planar portions of adjacent shingles provides particular advantages. For example, shingles whose central planar portion's second surface faces downward and toward substrate 140 may be walked on. Their central planar portions are in close enough contact with substrate 140 to avoid deformation of the central planar portion.

In addition, shingles may be fabricated such that opposite surfaces of their central planar portions have differing appearances (e.g., different colors, textures, shades, etc.). Alternating exposure of surfaces may be advantageously employed to impart a distinctive pattern to the roofing system.

The central planar portions of shingles of one plurality may be displaced with respect to the central planar portions of shingles of another plurality. By displacing shingles of different pluralities, a textured appearance may be achieved as well as shadowing (under suitable lighting conditions). Planar portions are said to be displaced with respect to each other when a significant separation distance exists between the planar portions.

A separation distance is a distance measured along an axis that is perpendicular to (i.e., normal to) at least one of the central planar portions. A separation distance is considered significant when it achieves a desired functional or aesthetic effect. As discussed below with reference to FIG. 2, a shingle according to various aspects of the present invention permits displacement by a separation distance that is substantially greater than the thickness of its central planar portion. Such a separation distance is highly significant because roofing systems using such shingles may achieve a textured appearance and provide shadowing (under suitable lighting conditions) even when the central planar portions are constructed only of thin sheet material.

Shingles in a system according to various aspects of the present invention may be displaced by a significant separation distance without the need for bulk materials. For example, exemplary shingles 122, 124, 132, and 134 in exemplary system 100 are fabricated from bent pieces of sheet metal, and include no bulk materials. The shingles include no nonmetallic material of any significant thickness. (A nonmetallic coating may develop or be applied on the surface of the shingles in system 100, but such material has no significant thickness.)

The omission of bulk materials provides particular advantages. For example, a plurality of like shingles may be installed in a roofing system with alternating surfaces of their central planar portions exposed to view. When a metal shingle is constructed with its central planar portion free of nonmetallic materials, both opposing surfaces of the central planar portion can be made to have similar appearance. Such a shingle may be installed onto a roofing substrate with either surface of its central planar portion exposed to view. Consequently, a plurality of such shingles (all of the same type) may be employed in a roofing system, with some shingles having the first surfaces of their central planar portions exposed, and the remaining shingles having the second surface of their central planar portions exposed.

The omission of bulk materials also facilitates flow of air in the space between a roofing substrate and a surfacing structure of a ventilated roofing system according to various aspects of the present invention. (An example of such a surfacing structure is the structure formed by, inter alia, shingles 122, 124, 132, and 134 in system 100.) As discussed below with reference to FIGS. 10–12, airflow between a roofing substrate and the underside of the surfacing structure lowers the temperature of the roofing substrate in hot climates, thus increasing cooling efficiency. In colder climates, such airflow helps prevent moisture accumulation in the vicinity of the roofing substrate.

The separation distance between shingles may be consistent throughout a roofing system. Alternatively, shingles of different pluralities may be displaced by different separation distances. Such variation in separation distances may be employed to achieve a desired aesthetic effect.

Figure 6:
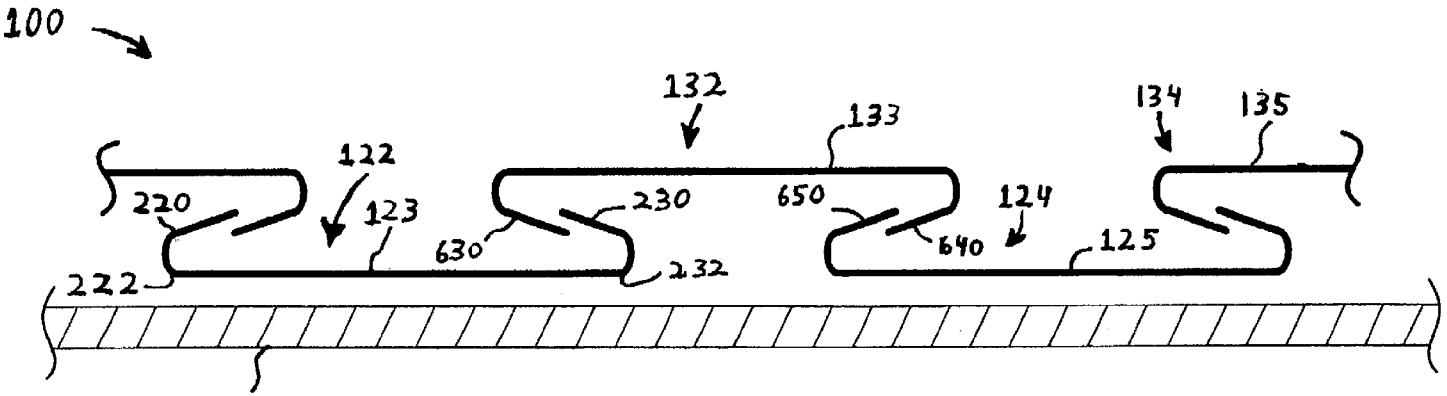
FIG. 6 is an end schematic view of the roofing system of FIG. 1 illustrating displacement between central planar portions of shingles of the system.
Figure 7:
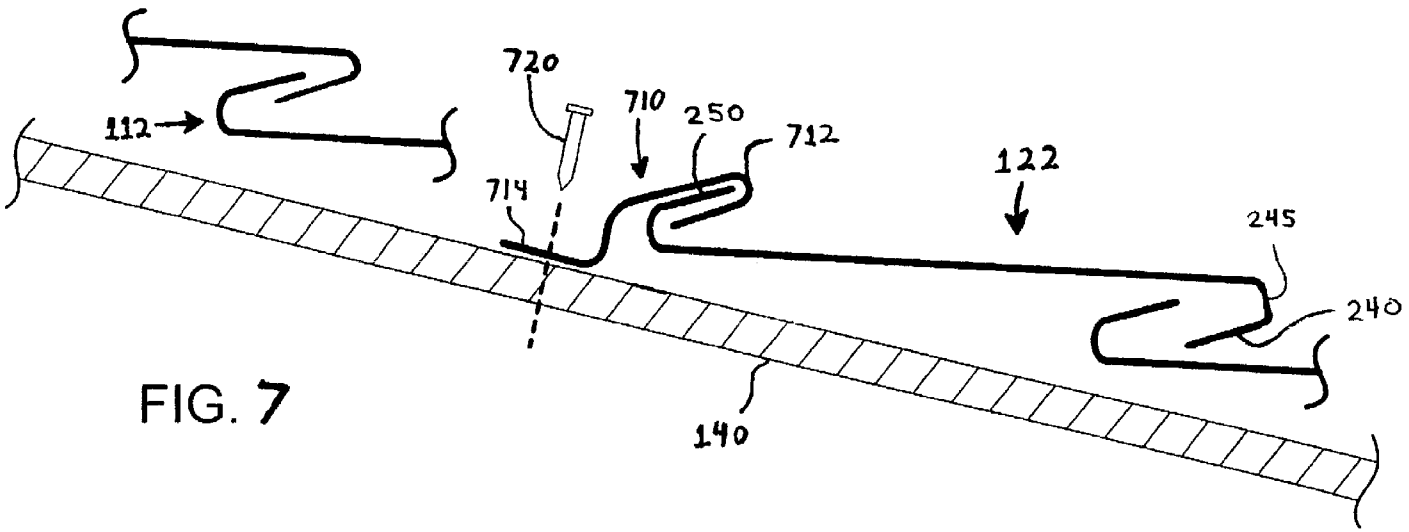
FIG. 7 is a side schematic view of the roofing system of FIG. 1 illustrating contact between the roofing substrate and a shingle of the system.

An example of displacement by a significant separation distance that is consistent throughout a roofing system may be better understood with reference to FIG. 6, which provides an exploded end view of roofing system 100. In system 100, shingles 122 and 124 are arranged such that their central planar portions 123 and 125 are substantially coplanar. Similarly, shingles 132 and 134 are arranged such that their central planar portions 133 and 135 are substantially coplanar. However, central planar portions 133 and 135 are displaced with respect to central planar portions 123 and 125 by a significant separation distance. The separation distance is substantially greater than the thickness of any of the central planar portions 123, 125, 133, and 135, which are free of bulk materials.

Shingles 132 and 134 of the second plurality are displaced with respect to shingles 122 and 124 of the first plurality. Central planar portions 133 and 135 of the second plurality, though substantially coplanar with each other, are not substantially coplanar with portions 123 and 125 of the first plurality. Shingles 122 and 124 are closer to substrate 140 than shingles 132 and 134. 25 Shingles 122 and 124 each contact substrate 140 at respective ends near the upper course of shingles 110. Shingles 132 and 134 and their respective central planar portions 133 and 135 are displaced, with respect to shingles 122 and 124 and their respective central planar portions 123 and 125, upwards and away from substrate 140.

Preferably, an average separation distance of at least one half inch exists between central planar portions 123/125 and central planar portions 133/135. In one embodiment, this average separation distance is about ⅝ inch. This separation distance is significant; it is substantially greater than the thickness of central planar portions 123, 125, 133, and 135. It is also more than 5 percent of the closest distance between edges of shingles of a given plurality. (In system 100, for example, this edge-to-edge distance is about 5 inches.) The separation distance between central planar portions 123, 125 and central planar portions 133, 135 is sufficient to effect a visually perceptible texturing of roofing system 100 when viewed from an expected viewing distance (e.g., about 100 feet).

As mentioned above, aesthetic benefits of the displacement of system 100 include a textured appearance and the availability of shadowing under suitable lighting conditions. FIG. 1 provides a simplified illustration of shadowing. Arrow 150 represents light impinging on system 100 from a light source (not shown) whose zenith is above and to the left of system 100.

Under illumination from light 150, shingle 114 casts a shadow 152 onto the left portion of shingle 116 and another shadow 154 onto the top portion (as seen in FIG. 1) of shingle 124. Because shingle 114 is displaced higher with respect to shingle 124 than with respect to shingle 116, shadow 154 is wider than shadow 152.

Other examples of shadows formed under illumination from light 150 are also illustrated in FIG. 1. As one example, shingle 114 casts a shadow 156 onto the top portion of shingle 132. Shadow 156 is cast onto a shingle 132 that is displaced higher (closer to shingle 114) than the shingle 124 onto which shadow 154 is cast. Consequently, shadow 156 is thinner than shadow 154, even though both are cast by shingle 114.

Shingle 112 casts a shadow 158 onto the top portion of shingle 132. Shingles 112 and 132 are not displaced from each other by a separation distance as great as that between shingle 114 and shingles 116, 132, and 124. Consequently, shadow 158 is thinner than shadows 152–156, which are cast by shingle 114.

A roofing system according to various aspects of the present invention may employ any suitable shingle to achieve the benefits of such a system (e.g., improved ventilation, textured appearance, etc.). As mentioned briefly above, shingle 122 (FIG. 2) is an exemplary shingle that provides particular advantages when employed in such a roofing system. Shingle 122 includes: central planar portion 123; a first edge portion 220 at a first edge 222 of portion 123; a second edge portion 230 at a second edge 232 of portion 123; a third edge portion 240 at a third edge 242 of portion 123; and a fourth edge portion 250 at a fourth edge 252 of central planar portion 123.

Central planar portion 123 has a first surface 210 and a second surface 212 opposite surface 210. Shingle 122 further includes a connecting portion 245, disposed between third edge portion 240 and edge 242. As discussed below, a shingle according to the invention may advantageously include a connecting portion to laterally elevate its third edge portion with respect to the first surface of its central planar portion. By laterally elevating edge portion 240 with respect to surface 210, for example, connecting portion 245 facilitates (1) engagement of opposite edge portions of shingles in adjacent courses of shingles, and (2) displacement of central planar portions of such shingles by a significant separation distance.

A connecting portion may be a portion of a single bent piece of sheet material, from which the central planar portion and edge portions may also be formed. A connecting portion may be rounded, partially rounded, or flat. The width of a connecting portion may vary, depending on various factors including pitch of a roofing substrate. For example, a shingle particularly suited for installation on a pitched substrate (e.g., having a pitch of 3:12 or greater) may have a wider connecting portion than a shingle suited more for installation on a relatively flat roofing substrate. The width of a connecting portion may also be varied to obtain a desired aesthetic effect, e.g., more pronounced texturing.

Connecting portion 245 of shingle 122 is formed from the same piece of sheet material as central planar portion 123 and edge portion 240. Connecting portion 245 is not flat; it is partially curved and effects a gradual transition in angular orientation between central planar portion 123 and edge portion 240.

First edge portion 220, second edge portion 230, and third edge portion 240 are all oriented at an acute angle with respect to surface 210. (Any suitable acute angle may be employed, for example about 20 degrees.) Edge portions 220 and 230 are preferably oriented at the same acute angle with respect to surface 210. Such a common orientation permits opposite edge portions of adjacent shingles in a given course of shingles to be more securely engaged together, as discussed below. Edge portion 240 may be oriented at the same angle as edge portions 220 and 230, or at a different acute angle.

Edge portion 240 and edge portion 250 face opposite surfaces of central planar portion 123. Fourth edge portion 250 is oriented at an acute angle with respect to surface 212, which is opposite surface 210. Consequently, edge portion 250 is oriented at an obtuse angle with respect to surface 210. Edge portions 240 and 250 are preferably oriented at the same acute angle with respect to surfaces 210 and 212, respectively. Such a common orientation permits opposite edge portions of shingles in adjacent courses of shingles to be more securely engaged together, as further discussed below.

Edge portions 220 and 230 are coupled to central planar portion 123 at opposite edges 222 and 232 of central planar portion 123. Edge portions 240 and 250 are coupled to central planar portion 123 at opposite edges 242 and 252. Edges of a central planar portion do not need to be exactly parallel to be opposite each other; edges are said to be opposite even when the edges are oriented at an angle with respect to each other. For example, a shingle having a particularly distinctive appearance, according to one aspect of the invention, has a central planar portion with a trapezoidal shape, rather than a rectangular shape. While two opposite edges of such a central planar portion are typically at least substantially parallel to each other, two other opposite edges are not parallel to each other.

An edge portion of a shingle according to various aspects of the present invention includes any flat portion of sheet material disposed at an edge of the central planar portion of the shingle. Preferably, the central planar portion and each edge portion of a shingle according to aspects of the invention are portions of a single bent piece of sheet material. Alternatively, one or more edge portions of the shingle may be formed from pieces of sheet material that are separate from, and coupled to, the central planar portion of the shingle.

An edge portion may be coupled to the central planar portion by any suitable form of attachment, with or without intervening structure. In a variation of shingle 122 where edge portions 220, 230, 240, and 250 are formed from sheet material separate from central planar portion 123, for example, edge portions 220, 230, and 250 may be welded to portion 123. In such a variation, edge portion 240 may include, or be attached to, connecting portion 245, which may be welded to portion 123.

An edge portion may have a length greater than, less than, or equal to the length of the particular edge to which it is coupled. In shingle 122, for example, edge portions 220 and 230 each have a length substantially equal to the lengths of edges 222 and 232, respectively, of central planar portion 123. Edge portion 240 may have a length somewhat shorter than the length of edge 242 of portion 123.

In exemplary shingle 122, edge portion 240 may have a length equal to the length of edge 242. Alternatively, edge portion 250 may have a length somewhat greater than the length of its respective edge 242 or 252 of central planar portion 123. The additional length is due to tabs 243 and 244 (or 253 and 254), which may extend beyond their respective edge portions 240 or 250 by a short distance, e.g., one inch. When used, tabs 243/244 or 253/254 provide additional coupling surface to help ensure that edge portion 240 or 250 is securely engaged with edge portions of adjacent shingles, even when radiusing is present between the shingles. Tabs 243/244 and 253/254 are depicted in FIG. 2 as alternative options of shingle 122 by the use of dashed lines, and tabs 253/254 are included in shingles of exemplary system 100. However, the tabs are omitted from view in FIGS. 1 and 3–7 for clarity. In variations where the benefits of tabs are not required, they may be omitted altogether.

Figure 2:
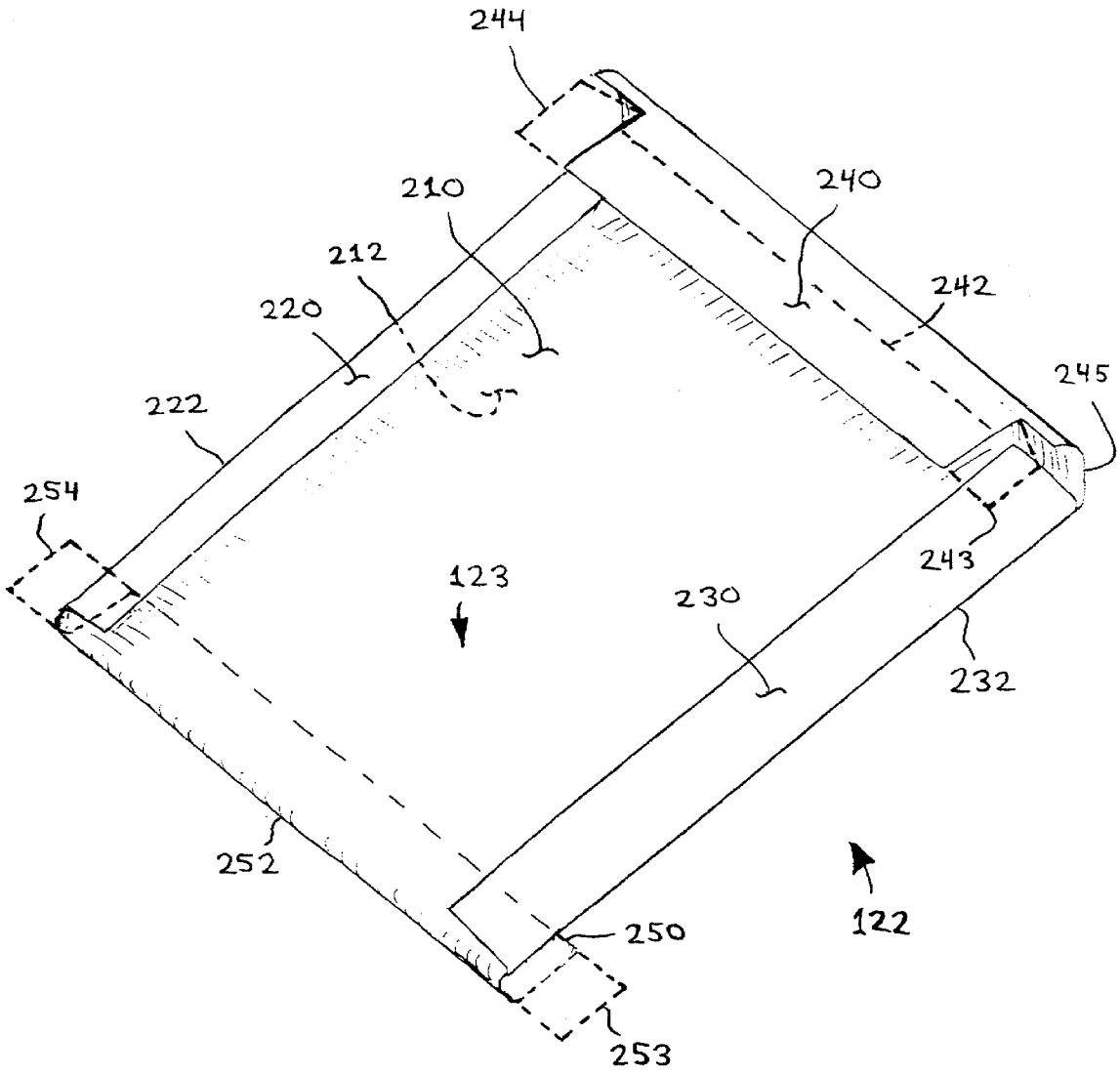
FIG. 2 is a perspective view of a surfacing shingle according to various aspects of the present invention.

As illustrated in FIG. 2, the only edge portions found at any edge of central planar portion 123 of shingle 122 and oriented at an acute angle with respect to surface 212 or surface 210 (which is opposite surface 212) are edge portions 220, 230, 240, and 250. Shingle 122 includes no other edge portions that are not coplanar with central planar portion 123.

Figure 3:
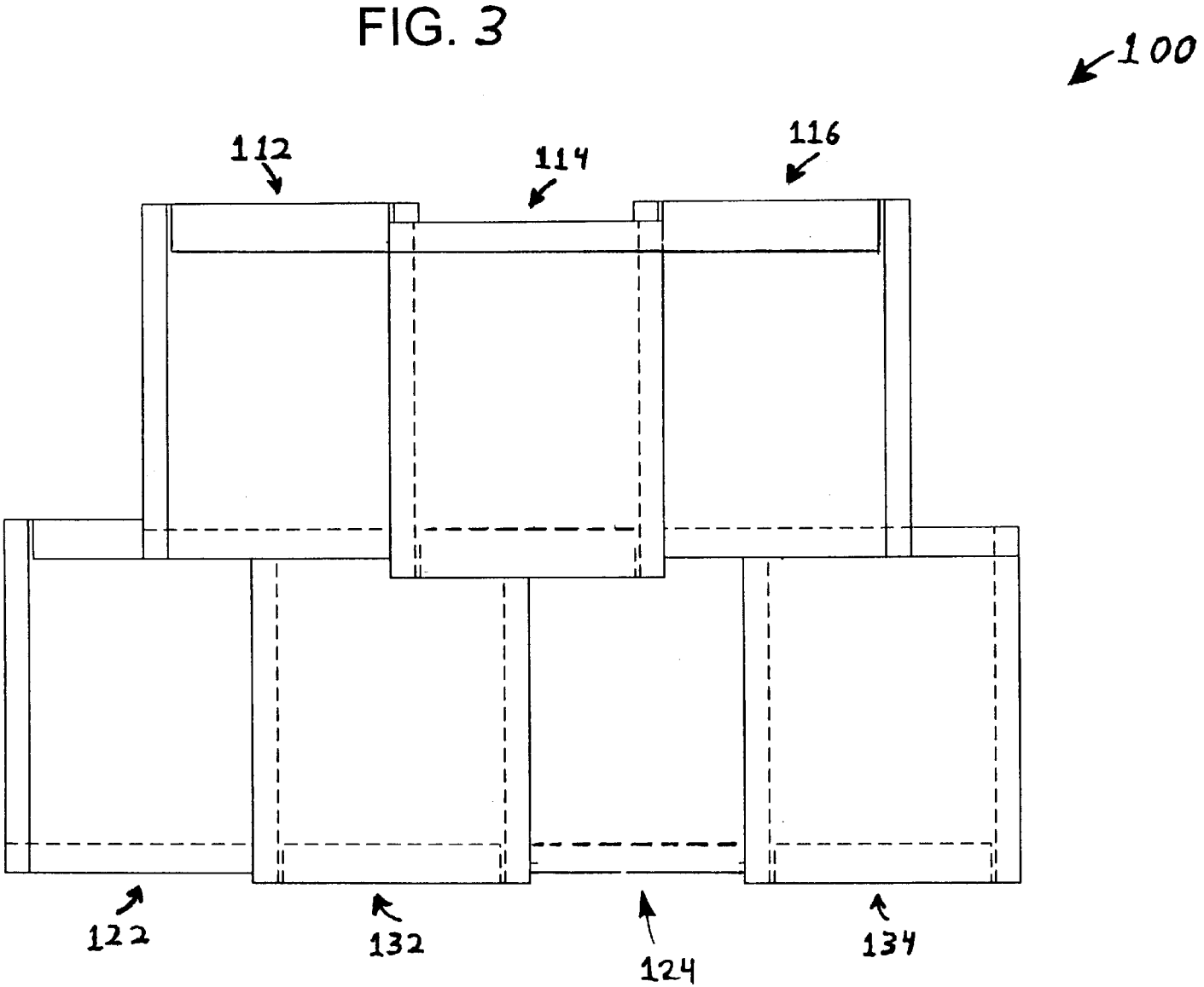
FIG. 3 is a schematic view of the roofing system of FIG. 1 showing points of interconnection between shingles of the system.
Figure 4:
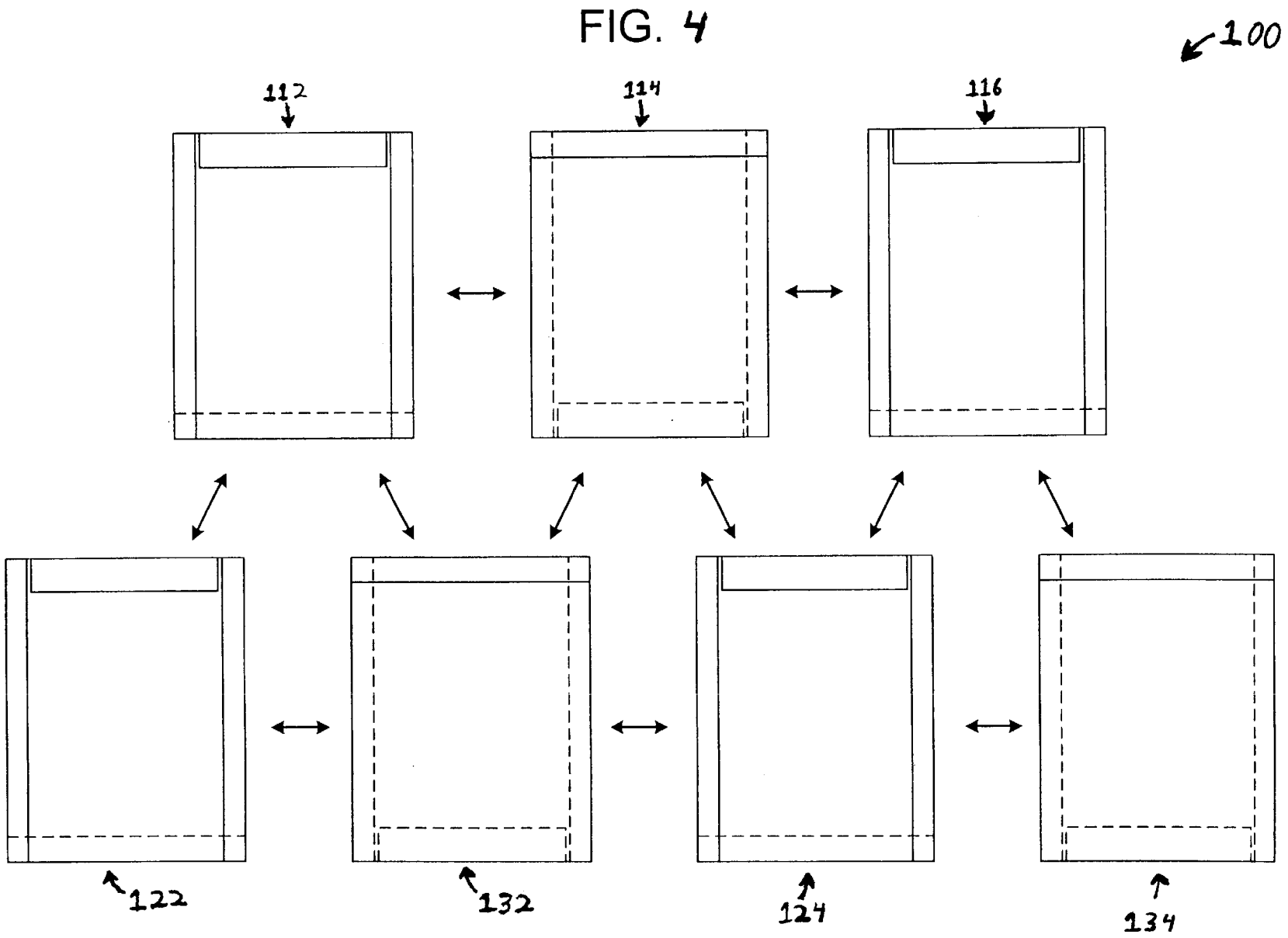
FIG. 4 is an exploded schematic view of the roofing system of FIG. 1 showing points of interconnection between shingles of the system.
Figures 5A, 5B:
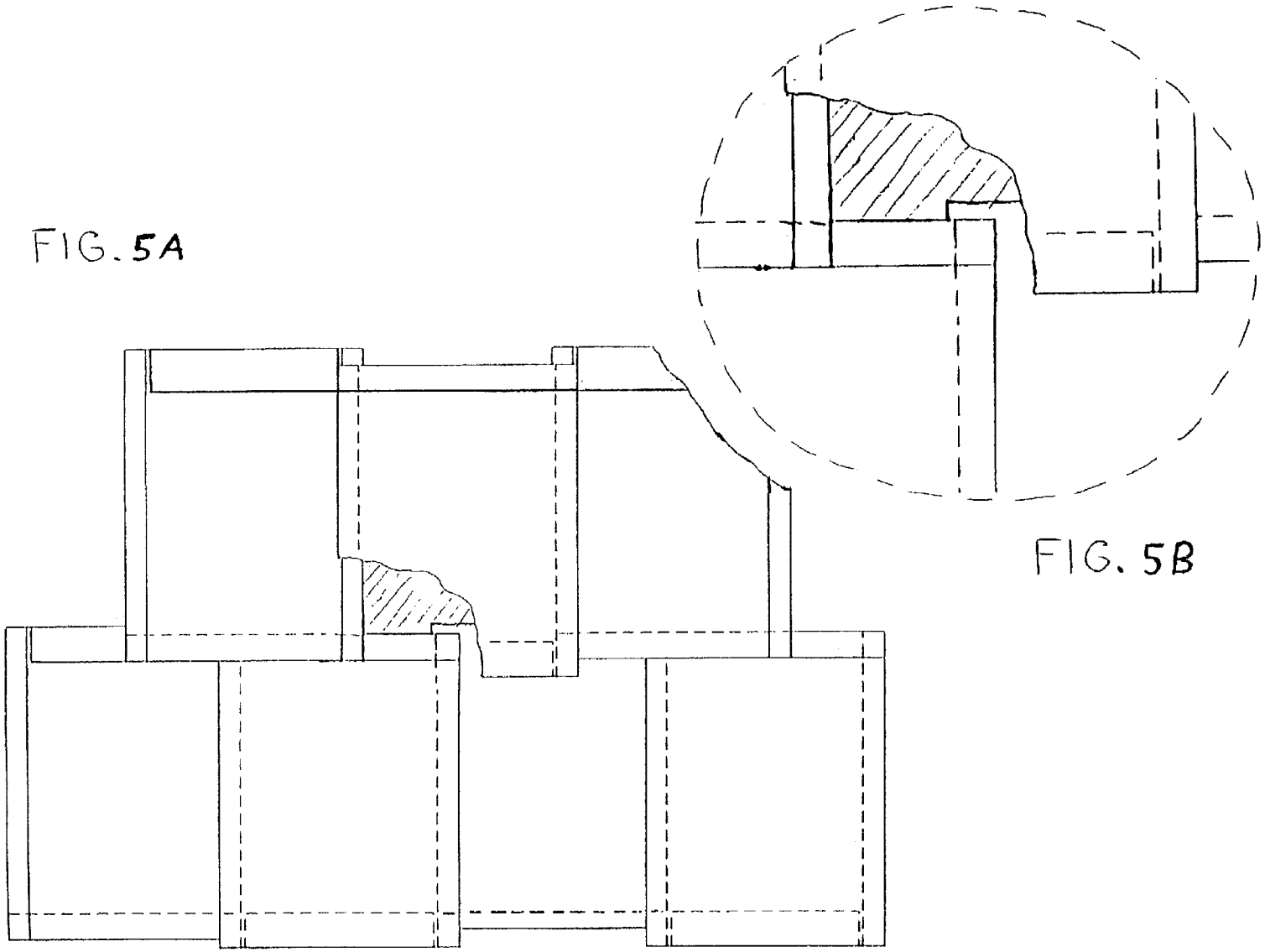
FIGS. 5A and 5B, is a cutaway schematic view of the roofing system of FIG. 1 showing points of interconnection between shingles of the system.

The arrangement of shingles in a roofing system according to various aspects of the present invention may be better understood with reference to FIGS. 3–7. In FIG. 3, shingles 112, 114, 116, 122, 132, 124, and 134 are shown engaged together (as in FIG. 1), with hidden edge portions of the shingles illustrated for clarity by dashed lines. The shingles are installed into system 100, in accordance with a method of the invention, by steps of (1) securing a shingle of the first plurality (e.g., shingles 122 and 124) to the substrate and (2) coupling shingles of the second plurality (e.g., 132 and 134) to the shingle of the first plurality. (As discussed below, these steps may be performed in a sequence other than that recited above.)

Advantageously, all shingles in system 100 may be installed from one supply (i.e., stock) of like shingles. A supply of like shingles may be transported to an installation site in a single container, without the need for differentiating shingles of different types for use in different pluralities.

In variations where the convenience of installation from a single supply of like shingles is not necessary, shingles in a group may have differing widths. Adjacent shingles within a group may have differing widths. Alternatively, all the shingles in one group may have a different width from all the shingles of another group. For example, each shingle of a first type of group may have a width of 4 inches, each shingle of a second type of group may have a width of six inches, and each shingle of a third type of group may have a width of 8 inches. The first, second, and third types of shingle groups may be interspersed throughout a roofing system to impart a distinctive appearance to the roofing system.

In an exemplary installation method, shingles are installed in one course before installation of another course of shingles is begun. A group of shingles may be preassembled and installed onto the substrate as a group. Alternatively, shingles may be installed onto the substrate one at a time, with each shingle of one plurality being secured to the substrate before an adjacent shingle of the opposite plurality is secured to it.

In a variation, shingles may be fabricated as a group from a single piece of sheet material, and left attached together. Shingles that are fabricated in this manner are "interconnected" together by their unitary construction rather than by the engagement of edge portions of adjacent shingles.

Installation begins, in the exemplary method, with securing of shingles 122, 132, 124, and 134 together as a group. Shingle 132 is secured to shingle 122 such that respective surfaces of central planar portions 123 and 133 of shingles 122 and 132 face opposite directions. Upon installation of the group onto substrate 140, the first surface of central planar portion 123 and the second surface of central planar portion 133 will face upwards and away from substrate 140.

As may be better understood with reference to FIGS. 3 and 6, shingle 132 is secured to shingle 122 by engagement between cooperating edge portions 230 and 630 of shingles 122 and 132, respectively. Shingle 124 is then secured to shingle 132 in the same manner and orientation as shingle 122. Shingle 124 is secured to shingle 132 by engagement between cooperating edge portions 640 and 650 of shingles 124 and 132, respectively. Finally, shingle 134 is secured to shingle 124 in the same manner and orientation as shingle 132.

In the assembled group, shingles 122 and 124 (of the first plurality) are secured to substrate 140 (shown in FIG. 1). Shingle 122 is oriented such that the first surface of its central planar portion 123 faces upwards and away from substrate 140. Similarly, shingle 124 is oriented such that the first surface of its central planar portion 125 faces upwards and away from substrate 140. Central planar portions 123 and 125 are substantially coplanar. Shingles may be secured to a substrate by any suitable material (adhesives, fasteners, etc.), using any suitable technique. As may be better understood with reference to the side schematic view of FIG. 7, for example, shingle 122 is secured to substrate 140 by a strap 710.

Strap 710 is fabricated from a single bent piece of sheet material and includes: a hook portion 712 for engaging edge portion 250 of shingle 122 and a flat portion 714 for receiving a fastener 720 to secure strap 710 to substrate 140. Fastener 720 may be of any suitable type, for example a nail or screw fastener. Hook portion 712 and flat portion 714 are connected by a bent connecting portion of strap 710.

Prior to installation, strap 710 may simply have the form of a flat strap of sheet material, and assume the form of a bent piece of sheet material (e.g., the form shown in FIG. 7) after installation. The dimensions of strap 710 may be varied proportionate to the dimensions of shingle 122. For example, preferred dimensions of strap 710 corresponding to preferred dimensions of shingle 122 call for hook portion 712 to be about ⅝ inch in length (from bend to edge) and the overall length including hook portion 712 to be about two inches. Preferably, strap 710 has a hole (e.g., ⅛ inch in diameter) provided in one end for ease of installation. Strap 710 may be fabricated from the same type of sheet material as shingle 122, which is preferably sheet metal.

In a variation, a central portion (e.g., ½ to 1 inch) of edge portion 250 of shingle 122 may be partially cut away so that it may extend directly from central planar portion 123. In such a variation, a separate strap such as strap 710 may be omitted because the extended portion provides a mounting strap for shingle 122 that is integrally connected to shingle 122. A hole may be provided at the end of such a mounting strap as part of the fabrication of shingle 122.

After installation of the group of shingles 122, 132, 124, and 134 onto substrate 140, additional shingles of course 120 (not shown in FIG. 1) may be installed. Course 110 of shingles 112, 114, and 116 may be installed before or after installation of additional shingles in course 120.

Roofing system 100 may include a third plurality of shingles (not shown) for installation at edges (e.g., at an eave, gable edge, or ridge) of roofing system 100. Shingles of the third plurality may resemble shingles of the first and second pluralities, but may be configured to cover the edges of system 100. When installed at an eave or gable edge, such shingles enclose the airspace between substrate 140 and the shingles of the first and second pluralities, keeping out foreign material (e.g., rain, snow, dirt, insects, vermin, etc.) When installed at a ridge, such shingles provide a transition from a portion of substrate on one side of the ridge to a portion of substrate on the other side of the ridge.

Shingles of the third plurality may be installed at an eave in a variation that does not provide ventilation between roofing substrate 140 and shingles of system 100. Shingles that are to be installed at an eave or gable edge may be bent such that one portion of each shingle covers the eave or gable edge while another portion is oriented parallel to substrate 140. The portion that is parallel to substrate 140 may include an edge portion for engaging an edge portion of a shingle of the first or second plurality.

When installation is complete, roofing system 100 comprises a plurality of interconnected shingles. Adjacent shingles in system 100 are secured together by engagement of their cooperating edge portions. As discussed above, a shingle according to various aspects of the present invention may include first and second edge portions at two opposing edges of a central planar portion, facing the same surface of the central planar portion. In addition, such a shingle may include third and fourth edge portions at two other opposing edges of the central planar portion, each facing opposite surfaces of the central planar portion. In system 100, adjacent shingles in a course of shingles (e.g., course 120) are secured together by engagement of their respective first and second edge portions. Shingles in adjacent courses (e.g., courses 110 and 120) are secured together by engagement of their respective third and fourth edge portions. This engagement between adjacent shingles and adjacent courses of shingles may be better understood with general reference to the exploded schematic view of FIG. 4 and to the cutaway schematic view of FIG. 5.

By providing many points of interconnection between adjacent shingles, through engagement of cooperating edge portions, a roofing system employing shingles according to various aspects of the present invention provides enhanced structural integrity in addition to its other benefits.

Figure 8:
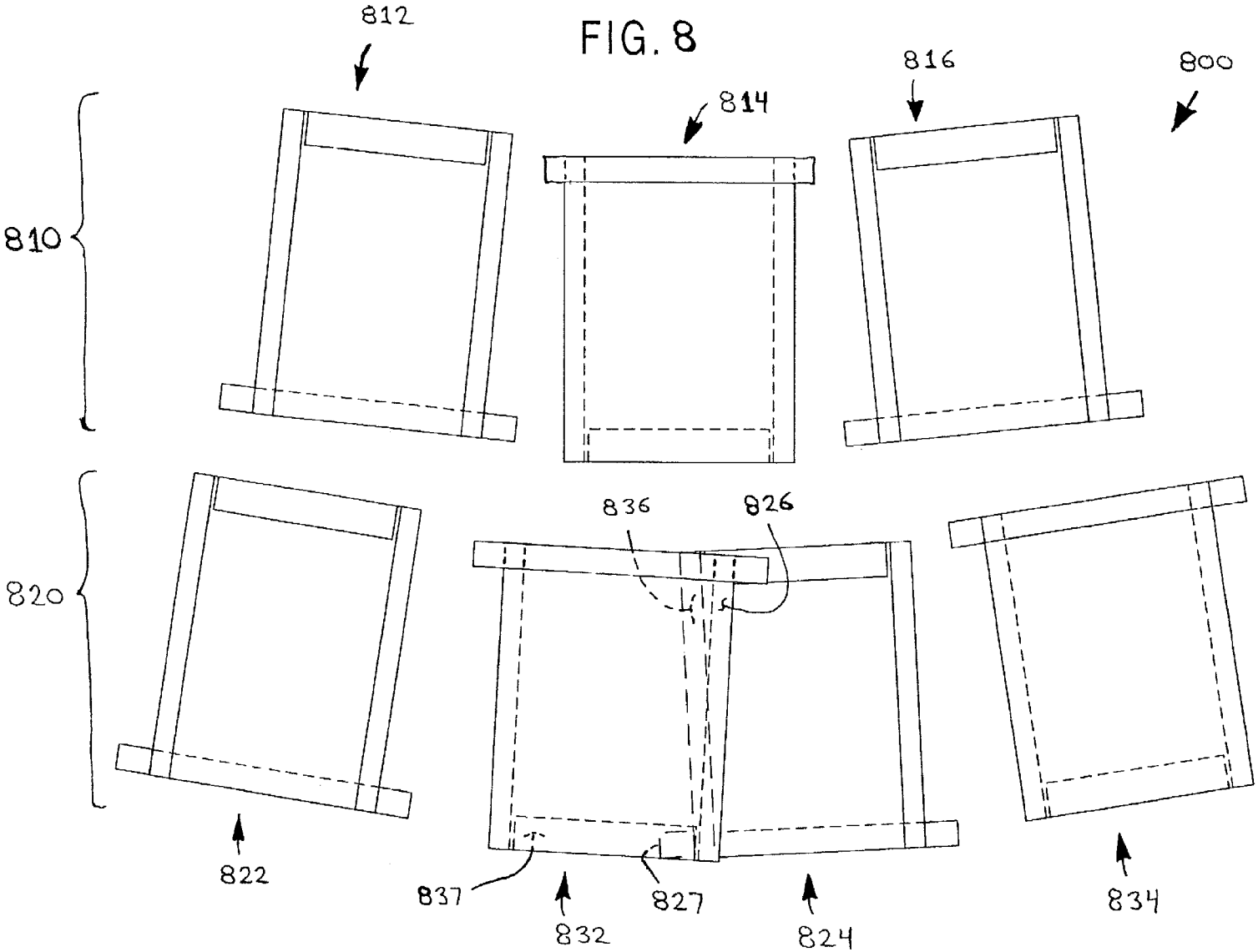
FIG. 8 is an exploded schematic view of a radiused roofing system according to various aspects of the present invention.

As may be better understood with reference to FIG. 8, a shingle according to various aspects of the present invention may be advantageously used in a radiused roofing system. In a radiused roofing system (e.g., system 800), adjacent shingles are arranged such that edges of one shingle are not exactly parallel or perpendicular to edges of an adjacent shingle. System 800 includes an upper course of shingles 810 and a lower course of shingles 820, arranged on a conventional roofing substrate (not shown). Upper course 810 includes shingles 812, 814, and 816. Lower course 820 includes a first plurality of shingles 822 and 824, and a second plurality of shingles 832 and 834.

The shingles of system 800 are of the same type as shingle 122, discussed above with reference to FIG. 2. Shingle 832 includes an edge portion 826, which is analogous to edge portion 220 of shingle 122, and an edge portion 837, which is analogous to edge portion 240 of shingle 122. Shingle 824 includes an edge portion 836, which is analogous to edge portion 220 of shingle 122. As discussed below, edge portions 836 and 826 are engaged together in roofing system 800.

One edge portion of each shingle of system 800 is longer than the edge of the central planar portion to which it is coupled. Each shingle includes tabs that extend beyond the width of the shingle. Shingle 824 includes a tab 827, which is analogous to tab 254 of shingle 122.

The shingles of system 800 are arranged such that adjacent shingles are oriented at an angle with respect to each other. In the schematic view of FIG. 8, this angle of orientation is only exemplary; other angles may be encountered. For example, adjacent shingles may be oriented at a sharper angle in a "turret" style roof, which may be found in architecture imitating the style of medieval castles. In installations such as a "turret," where extremely sharp radiusing is required, shingles may be trapezoidal shaped to better accommodate the radiusing.

Edge portions 836 and 826 of shingles 832 and 824, respectively, engage each other at an angle. Edge portions 836 and 826 have sufficient width to engage each other for much of their respective lengths, having greater overlap with each other at one end of their respective shingles than at the opposite end. Tab 827 engages edge portion 837, which helps to engage shingles 832 and 824 more securely together. Tab 827 may be fastened (e.g., by spot welding, crimping, riveting, etc.) to edge portion 837 to further secure the engagement of shingles 832 and 824, if desired. Fastening may be performed upon installation or during shingle fabrication.

Because the central planar portions of adjacent shingles in system 100 are displaced with respect to each other, an airspace is formed between substrate 140 and the surfacing structure of system 100. (The surfacing structure of system 100 is comprised of its shingles, including shingles 112, 114, 122, 132, etc.) Likewise, an airspace is formed between the surfacing structure of system 800 (FIG. 8) and the substrate onto which system 800 is installed. By providing ventilation ports for coupling (i.e., venting) this airspace to the exterior of system 100, ventilation may be advantageously provided between substrate 140 and the surfacing structure of system 100.

Ventilation between a roofing substrate and a surfacing structure mitigates the heating effect of solar absorption by the structure in hot and sunny climates, and helps to prevent moisture buildup in the vicinity of the substrate in cooler climates. Such ventilation may be employed as an alternative to ventilation that is conventionally provided beneath the substrate. Alternatively, ventilation between substrate and surfacing structure may be used in conjunction with ventilation provided beneath the substrate to improve overall ventilation.

A ventilated roofing system according to various aspects of the present invention includes any surfacing structure that may be coupled to a roofing substrate and elevated with respect to the substrate such that an airspace is disposed between the substrate and the underside of the surfacing structure. In such a system, ventilation between two separate portions of the substrate is provided by making the airspace accessible to the separate portions of the substrate.

Shingles of the type of shingle 122 (FIG. 2) may be suitably installed onto the substrate to form a suitable surfacing structure, as in system 100. Shingles according to various aspects of the present invention are particularly advantageous because they inherently provide the desired elevation with respect to the substrate. However, any surfacing structure that may be suitably elevated with respect to a substrate may be employed. For example, metallic panels of a standing-seam roof may be coupled to a roofing substrate using struts or air-permeable blocks to elevate the panels with respect to the substrate. As a further example, conventional shingles (metallic or otherwise) may be assembled into a surfacing structure and suitably coupled to a roofing substrate at a desired elevation by resting the shingles on a wire mesh or latticework, which is supported by struts or air-permeable blocks to elevate the shingles with respect to the substrate.

Figure 10:
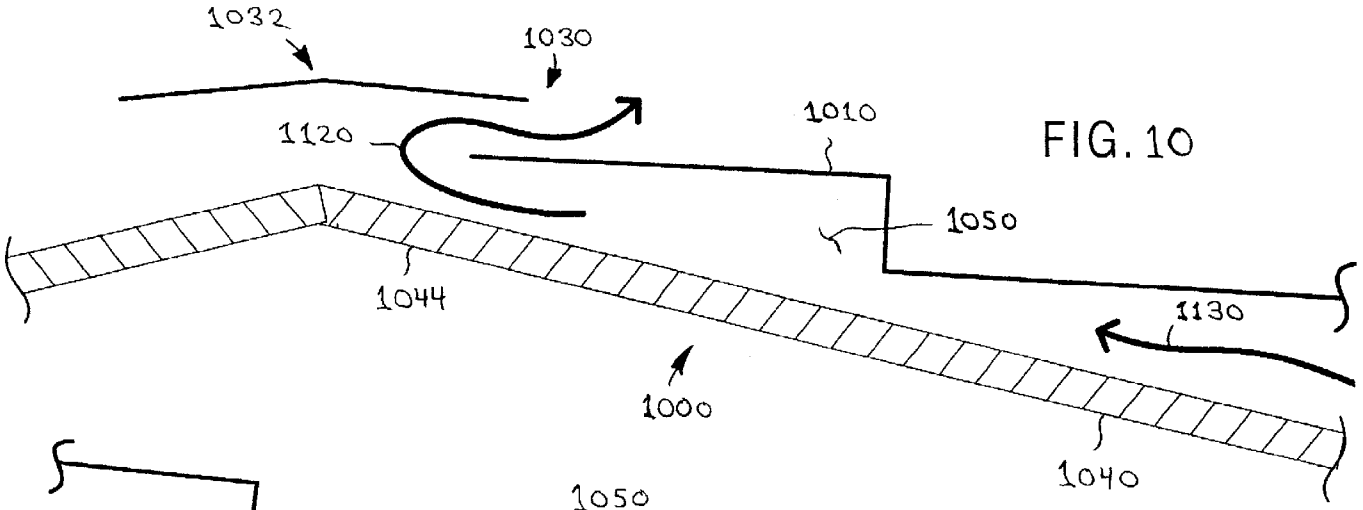
FIG. 10 is a side schematic view illustrating airflow through a ventilation port in a first portion of a ventilated roofing system according to various aspects of the present invention.
Figure 11:
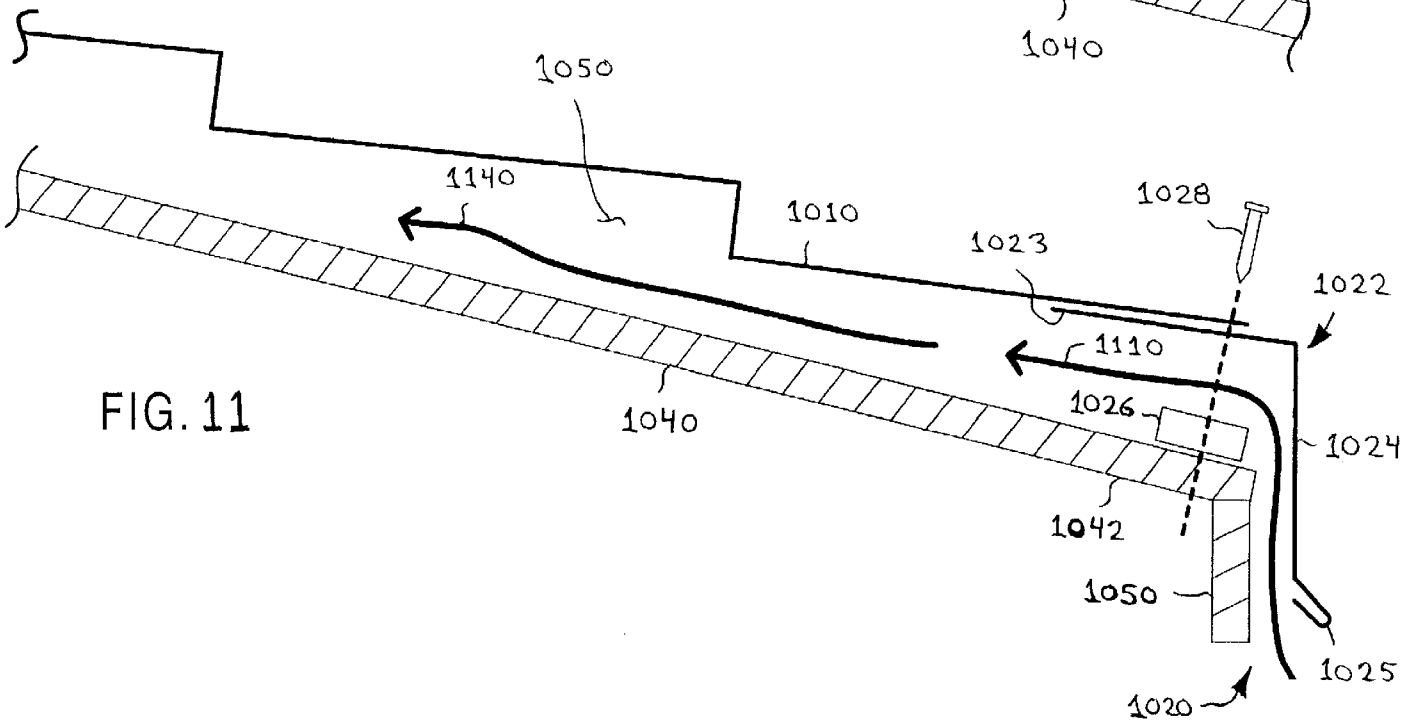
FIG. 11 is a side schematic view illustrating airflow through another ventilation port in a second portion of the ventilated roofing system of FIG. 10.

A ventilated roofing system 1000 according to various aspects of the present invention may be better understood with reference to the side schematic views of FIGS. 10 and 11. System 1000 includes: a surfacing structure 1010; a first ventilation port 1020; and a second ventilation port 1030. Surfacing structure 1010 is suitably coupled to a conventional roofing substrate 1040, which has a first portion 1042 proximate (i.e., near) ventilation port 1020 and a second portion 1044 proximate ventilation port 1030. In a variation, substrate 1040 may be considered an integral part of system 1000, for example where system 1000 is a prefabricated roofing section.

Any suitable support structure may be employed to elevate a surfacing structure from a substrate in a ventilated roofing system according to various aspects of the present invention. Shingles according to various aspects of the invention inherently provide such support structure. Solid (i.e., not inherently air-permeable) support structures may be used as long as sufficient airspace is provided between the structures, or through ventilation holes of the support structures, to allow the airspace to be accessible to two portions of the substrate that are separated by the support structures. For example, surfacing structure 1010 may be coupled to roofing substrate 1040 by any suitable support structure that permits structure 1010 to be elevated with respect to substrate 1040 such that (1) an airspace 1050 is present between substrate 1040 and the underside of structure 1010; and (2) airspace 1050 is accessible to both portion 1042 and 1044 of substrate 1040.

As discussed above, struts or air-permeable blocks (not shown) may be employed to elevate surfacing structure 1010 while permitting airspace 1050 to be accessible to both portions 1042 and 1044. Struts may be disposed at regular intervals throughout the area of substrate 1040 such that surfacing structure 1010 is supported and ventilated air in airspace 1050 is able to flow from ventilation port 1020 to ventilation port 1030, around the struts. Air-permeable blocks may be disposed along the length of substrate 1040 to support structure 1010 without obstructing such a flow of air, even if the blocks are oriented perpendicular to the expected or desired direction of flow. Suitable air-permeable blocks may be constructed of porous materials (e.g., a rigid metallic mesh or lattice) or of solid material provided with ventilation holes.

An airspace is said to be accessible to two portions of a substrate when air that is in a region of the airspace proximate one portion may move (e.g. by ventilation) to a region of the airspace proximate the other portion. For an airspace to be accessible to two portions of the substrate, there does not need to be a constant volume of airspace per unit of substrate area between the portions. It is sufficient that there be enough volume of airspace per unit of substrate area to facilitate ventilation of the airspace between ventilation ports at the respective portions of the substrate. As may be better understood with reference to FIG. 12, for example, the airspace beneath the surfacing structure of system 100 has a widely varying volume per unit of substrate area. This volume ranges from zero (e.g., at location 1210, where shingle 124 touches substrate 140) to a maximum value (e.g., at location 1220, between substrate 140 and the part of the central planar portion of shingle 114 nearest shingle 124).

A ventilation port according to various aspects of the present invention includes any suitable structure for coupling an airspace within a roofing system to the exterior of the roofing system. For example, ventilation port 1020 of FIG. 11 couples airspace 1050, at the region proximate portion 1042 of substrate 1040, to the exterior of roofing system 1000. As illustrated by airflow vector 1110, air from the exterior of roofing system 1000 is drawn through ventilation port 1020 and into airspace 1050 at an eave 1050, which abuts substrate 1040. Another example of a ventilation port is ventilation port 1030, which couples airspace 1050 (at the region proximate portion 1044 of substrate 1040) to the exterior of roofing system 1000.

Ventilation port 1020 is formed from an edge structure 1022, which cooperates with portions 1042 of substrate 1040 and eave 1050. Edge structure 1022 may be fabricated from a bent piece of sheet material, preferably the same type of sheet material used in surfacing structure 1010. Edge structure 1022 includes a first portion 1023, which is oriented substantially parallel to substrate 1040, and a second portion 1024, which is oriented substantially parallel to eave 1050. The lower edge of edge structure 1024 is preferably bent inwards on itself to form a closed hem 1025.

Edge structure 1022 is secured to substrate 1040 such that portions 1023 and 1024 are positioned away from substrate 1040 and eave 1050, respectively, to form a ventilation path between airspace 1050 and the exterior of roofing system 1000. For example, portion 1023 of edge structure 1022 may be secured to portion 1042 of substrate 1040 through an intervening offsetting structure 1026 using a suitable fastener 1028. Offsetting structure 1026 may be any suitable structure for elevating edge structure portion 1023 from substrate portion 1042 without disrupting ventilation. For example, offsetting structure 1026 may be comprised of one or more neoprene washers, 1 ½ inches in diameter and of suitable thickness. Fastener 1028 may be of any suitable type, for example a nail or screw fastener. Offsetting structure 1026 and fastener 1028 may be duplicated along the length of eave 1050 at suitable intervals.

Ventilation port 1030 (FIG. 10) is formed from a ridge structure 1032, which cooperates with portion 1044 of substrate 1040. Ridge structure 1032 may be fabricated from a slightly bent piece of sheet material, which may be the same type of sheet material used in surfacing structure 1010. Ridge structure 1032 is suitably positioned away from substrate 1040 and surfacing structure 1010, by an intervening offsetting structure (not shown), to form a ventilation path between airspace 1050 and the exterior of roofing system 1000. As illustrated by airflow vector 1120, air exits the exterior of roofing system 1000 through ventilation port 1030.

Ventilation ports 1020 and 1030 are preferably filtered and/or baffled with air-permeable material or structure to keep foreign material (e.g., rain, snow, dirt, insects, vermin, etc.) out of airspace 1050.

Conventional ventilation ports may be adapted for ventilating an airspace above a substrate (rather than an attic space below substrate) for use in a ventilated roofing system in accordance with the invention. When used in this manner, a conventional ventilation port does not necessarily couple an airspace beneath a substrate to the exterior of a roofing system through a hole in the substrate. Instead, the port couples an airspace beneath the surfacing structure of the roofing system to the exterior through a hole in the surfacing structure. No holes are needed in the substrate for such ventilation. However, holes may still be provided, for example to provide conventional ventilation of an attic space beneath the substrate, or to couple air to an airspace between substrate and surfacing structure from a conventional soffit vent located beneath the substrate at an eave.

Ventilation ports and associated mounting positions and techniques, which may be employed in a ventilated roofing system of the invention with suitable adaptation, may be of the type disclosed in the following U.S. Pat. No. 4,325,290 to Wolfert; U.S. Pat. No. 4,762,053 to Wolfert; U.S. Pat. No. 4,776,262 to Curran; U.S. Pat. No. 5,122,095 to Wolfert; U.S. Pat. No. 5,457,920 to Waltz; and U.S. Pat. No. 5,921,863 to Sells. The detailed description portion (including referenced drawing figures) of each of these six aforementioned patents is incorporated herein by reference. Further, the detailed description portion (including referenced drawing figures) of any U.S. patent or U.S. patent application incorporated by reference into any of these six aforementioned patents is also specifically incorporated herein by reference.

An airspace in a ventilated roofing system according to various aspects of the present invention may be ventilated by any suitable technique, including both forced-air ventilation and natural convection. One or more fans may be employed to effect forced-air ventilation. Fans may be incorporated into one or more ventilation ports, or suitably positioned in the airspace.

To facilitate convective ventilation in a ventilated roofing system according to various aspects of the invention, a portion of the roofing substrate proximate one ventilation port may be advantageously positioned lower than a portion proximate another ventilation port. Such positioning may be obtained in a conventionally sloped roofing system and substrate. When one ventilation port is positioned lower than another, air that is heated in the airspace between surfacing structure and substrate can rise and effect airflow from the lower ventilation port to the upper port. For example, air in airspace 1050 of system 1000 may be heated, from solar absorption by surfacing structure 1010 or by conduction of building heat through substrate 1040, and rise upwards above sloped substrate 1040. Airflow in airspace 1050 is represented by airflow vectors 1110, 1120, 1130, and 1140. This rising of air causes air to be drawn into airspace 1050 through ventilation port 1020 and causes air to be pushed out of airspace 1050 through ventilation port 1030.

Figure 12:
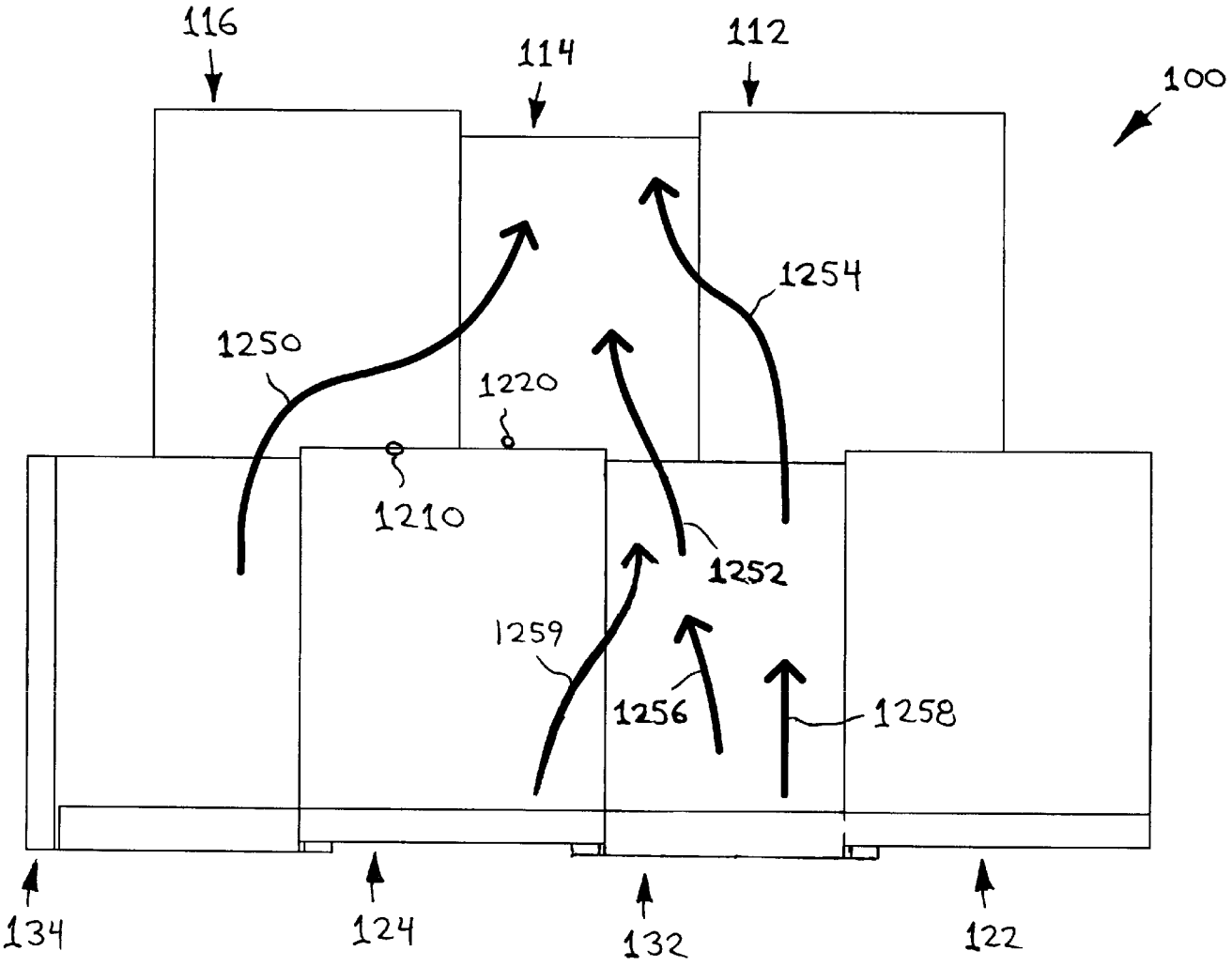
FIG. 12 is a bottom view of the roofing system of FIG. 1 illustrating airflow in an airspace according underneath the surfacing structure of the roofing system of FIG. 1 when ventilation is provided, to various aspects of the present invention.

An example of airflow in the airspace of a ventilated roofing system of the invention may be better understood with reference to FIG. 12. The surfacing structure formed by, inter alia, shingles 122, 132, 124, 134, 112, 114, and 116 of roofing system 100 may be viewed from the underside in FIG. 12, without being obscured by substrate 140. Airflow beneath this surfacing structure is illustrated in FIG. 12 by airflow vectors 1250–1259.

Airflow vectors 1250–1259 illustrate how air may flow beneath surfacing shingles of the invention in a ventilated roofing system, even when some of those shingles make direct contact with a roofing substrate. For example, airflow vector 1250 illustrates how air may flow beneath shingle 134, then beneath shingle 116, then beneath shingle 114 to avoid location 1210, where shingle 124 touches substrate 140 (not shown). Airflow vectors 1256 and 1258 illustrate how air flows beneath shingles such as shingle 132 whose central planar portions are displaced upwards and away from substrate 140. Airflow vectors 1252 and 1254 illustrate how air flows from beneath one such shingle to another. Airflow vector 1259 illustrates how air flows beneath portions of shingle 124 that do not contact substrate 140.

Although ventilation is particularly advantageous in a roofing system, ventilation may also be advantageously provided in other types of installations. For example, surfacing shingles according to the invention, described above, may be installed onto a south-facing wall of a structure. When ventilation is provided in such an installation, the heating effects of sunlight on such a wall may be mitigated.

As mentioned above, and exemplified in FIG. 12, shingles according to various aspects of the present invention (e.g., shingle 122 of FIG. 2) are advantageous in that they may be installed onto a roofing substrate without intervening structure to create an airspace that is accessible to separate portions of the substrate. As illustrated by airflow vectors 1250–1258, air is free to flow in the airspace beneath the surfacing structure formed by shingles of system 100.

Shingles may be of any desired dimensions. Dimensions may be selected in accordance with various factors, e.g., individual preference, the size of the surface to be covered by the shingles, material from which the shingles are fabricated, etc. For example, shingles used in wall siding may have different dimensions (and appearance) from shingles used in a roofing system. Examples of shingles used for wall siding include vinyl shingles for covering an exterior wall and shingles fabricated from acoustic material for application to an interior wall.

Shingles of varying dimensions may be used within a single installation. For example, a single large shingle may be employed to cover a central region of a substrate. The large shingle may be surrounded by numerous smaller shingles. Edge portions of numerous smaller shingles may interconnect with each edge portion of such a larger shingle.

Exemplary dimensions of shingle 122 are provided in TABLE I below. A shingle having these dimensions may be conveniently moved and installed by hand, even when pre-assembled in a group of four shingles. However, any dimensions suitable for a given installation may be used.

TABLE I

| Portion | Exemplary Preferred Dimension |
|---|---|
| Rectangular portion 910 - length (between opposite edges) | 12 inches |
| Rectangular portion 910 - width (between opposite edges) | 7 inches |
| Edge portions 220, 230 - length | 12 inches |
| Edge portions 220, 230 - width | 0.75 inches |
| Edge portion 240 - length | 7.25 inches |
| Edge portion 240 - width | 1.3 inch |
| Edge portion 250 - length | 7.25 inches |
| Edge portion 250 - width | 0.75 inch |
| Connecting portion 245 - length | 7.25 inches |
| Connecting portion 245 - width | 0.6 inches |

Figure 9:
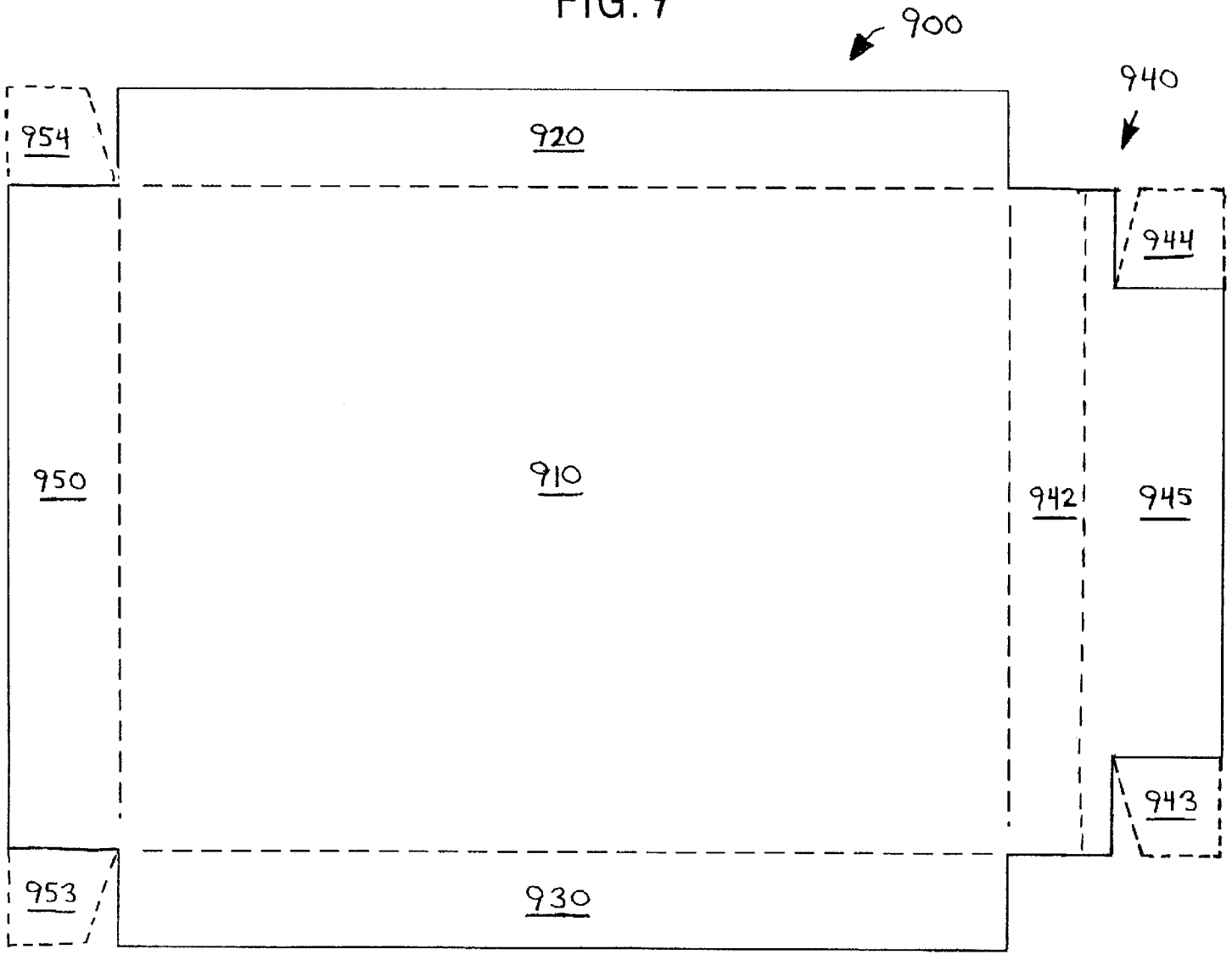
FIG. 9 is a top view of a piece of sheet metal prior to being bent to form the surfacing shingle of FIG. 2.

A shingle according to various aspects of the present invention may be fabricated by any suitable technique, and from any suitable materials. For example, shingle 122 may be fabricated from a single bent piece of sheet material, preferably sheet metal. Prior to bending, such a piece of sheet material may be cut or stamped from a larger sheet of stock material. As may be better understood with reference to FIG. 9, a piece 900 of sheet material suitable for being bent to form shingle 122 includes: a central rectangular portion 910; long-side extensions 920 and 930; and short-side extensions 940 and 950. Lines (i.e., breaks) along which piece 900 is bent are depicted in FIG. 9 as dashed lines within the perimeter of piece 900.

After bending, central rectangular portion 910 forms central planar portion 123. Long-side extensions 920 and 930 form edge portions 220 and 230, respectively. Short-side extension 950 forms edge portion 250. Short-side extension 940 includes two portions 942 and 945, which form connecting portion 245 and edge portion 240, respectively.

To form shingle 122, long-side extensions 920 and 930 are both bent upwards (toward the viewer of FIG. 9) and over central rectangular portion 910. Short-side extension 950 is bent downwards (away from the viewer of FIG. 9) and under portion 910. Portion 942 of short-side extension 940 is bent upwards and perpendicular to central rectangular portion 910. Portion 945 of short-side extension 940 is bent further such that it is perpendicular to portion 942 and nearly parallel (e.g., within 20°) to central rectangular portion 910.

As discussed above, tabs may be included on an edge portion of a shingle according to the invention to provide additional coupling surface between shingles. Tabs 243 and 244 may be formed from extensions 943 and 944, respectively, of short-side extension 940. Alternatively, tabs 253 and 254 may be formed from extensions 953 and 954, respectively, of short-side extension 950. Extensions 943, 944, 953, and 954 are depicted in FIG. 9 as alternative options by the use of dashed lines.

Dimensions of piece 900 are selected to conform to desired dimensions of shingle 123. Rounded edges between adjacent portions of piece 900 take up material from piece 900 that would otherwise be present in adjacent portions of shingle 123 formed from the adjacent portions of piece 900. Dimensions of piece 900 should be selected accordingly. For example, portion 942 is preferably a bit wider than the preferred 0.6 inches of connecting portion 245, and portion 945 is preferably a bit wider than the preferred 1.3 inches of edge portion 240.

While the present invention has been described in terms of preferred embodiments and generally associated methods, it is contemplated that alterations and permutations thereof will become apparent to those skilled in the art upon a reading of the specification and study of the drawings. For example, metal shingles are employed in the advantageous preferred embodiments disclosed above. Metal shingles are considered desirable in many roofing installations due to their longevity and their distinctive appearance. Copper is considered a particularly desirable metal for fabrication of a shingle, but any suitable metal may be used. A protective resin or patina may be applied to the shingle, or omitted, depending on the metal used and the desired appearance. In variations where a particular blackened appearance is desired, sulfur potash may be applied to a copper shingle. In embodiments where the benefits of metal shingles are not required, other suitable types of sheet material such as vinyl of suitable grade and thickness may be employed.

Accordingly, the present invention is not intended to be defined by the above description of preferred exemplary embodiments. Rather, the present invention is defined variously by the issued claims. Each variation of the present invention is intended to be limited only by the recited limitations of its respective claim, and equivalents thereof, without limitation by terms not present therein. Further, the present invention is particularly pointed out and distinctly claimed using terminology that Applicant regards as having its broadest reasonable interpretation; the more specific interpretations of 35 U.S.C. § 112(6) are only intended in those instances where the term "means" is actually recited.

What is claimed is:

1. A surfacing shingle comprising:

(a) a central planar portion, the central planar portion having a first surface and a second surface opposite the first surface;

(b) a first edge portion at a first edge of the central planar portion, oriented at an acute angle with respect to the first surface;

(c) a second edge portion at a second edge of the central planar portion, oriented at an acute angle with respect to the first surface, the first and second edges of the central planar portion being opposite;

(d) a third edge portion at a third edge of the central planar portion, oriented at an acute angle with respect to the first surface; and (e) a fourth edge portion at a fourth edge of the central planar portion, oriented at an acute angle with respect to the second surface, the third and fourth edges of the central planar portion being opposite;

wherein:

(f) the only edge portions that are not coplanar with the central planar portion at any edge thereof are the first, second, third, and fourth edge portions.

2. The surfacing shingle of claim 1 wherein:

(a) the third edge portion is oriented at a first acute angle with respect to the first surface;

(b) the fourth edge portion is oriented at a second acute angle with respect to the second surface; and (c) the first acute angle is substantially equal to the second acute angle.

3. The surfacing shingle of claim 2 wherein the first and second acute angles are about 0–20 degrees.

4. The surfacing shingle of claim 1 wherein the central planar portion and the first, second, third, and fourth edge portions are portions of a single bent piece of sheet material.

5. The surfacing shingle of claim 4 wherein the sheet material is sheet metal.

6. The surfacing shingle of claim 5 wherein the sheet metal is copper.

7. The surfacing shingle of claim 1 further comprising a connecting portion, disposed between the third edge portion and the central planar portion so as to laterally elevate the third edge portion with respect to the first surface.

8. The surfacing shingle of claim 7 wherein the connecting portion and the third edge portion each have a respective width, the width of the connecting portion being about one fourth to one half of the width of the third edge portion.

9. The surfacing shingle of claim 1 wherein:

(a) the third edge portion is oriented at an angle of about 10–20 degrees with respect to the first surface; and (b) the fourth edge portion is oriented at an angle of about 10–20 degrees with respect to the second surface.

10. The surfacing shingle of claim 1 wherein the central planar portion, the first, second, third, and fourth edge portions, and the connecting portion are portions of a single bent piece of sheet metal.

11. The surfacing shingle of claim 10 wherein the sheet metal is copper.

12. A method for installing shingles onto a roofing substrate, the method comprising:

(a) providing a plurality of like shingles, each shingle of the plurality including a central planar portion fabricated of sheet material and having a first surface and a second surface opposite the first surface, wherein the first and second surfaces are visually or structurally distinct; and (b) installing the plurality of shingles onto the substrate such that:

(1) a first shingle of the plurality is secured to the substrate, the first surface of the central planar portion of the first shingle facing away from the substrate;

(2) a second shingle of the plurality is coupled to the first shingle, the second surface of the central planar portion of the second shingle facing away from the substrate; and (3) a third shingle of the plurality is coupled to the substrate and to the second shingle, the first surface of the central planar portion of the third shingle facing away from the substrate.

13. The method of claim 12 wherein the second shingle of the plurality is coupled to the first and third shingles of the plurality prior to installation of the plurality of shingles onto the substrate.

14. The method of claim 12 wherein each central planar portion is fabricated of sheet metal.

15. The method of claim 14 wherein each central planar portion is fabricated of copper.

16. The method of claim 12 wherein securing to the substrate comprises:

(a) providing a fastener and a strap having a hook portion and a flat portion;

(b) engaging the hook portion with an edge portion of a shingle to be secured to the substrate; and (c) securing the fastener to the flat portion and the substrate.

17. The method of claim 12 wherein the second shingle is coupled to the first shingle such that the second surface of the second shingle is separated from the substrate by a separation distance substantially greater than the thickness of the planar portion of the second shingle.

18. The method of claim 17 wherein the separation distance is at least about five percent of the closest distance between the first shingle and the third shingle.

19. The method of claim 18 wherein the separation distance is about one fourth inch.

20. The surfacing shingle of claim 1 wherein the central planar portion has a perimeter that is substantially surrounded by the first, second, third, and fourth edge portions.

21. The surfacing shingle of claim 1 wherein the first and second edge portions have lengths that are substantially the same as lengths of the first and second edges, respectively.

22. The method of claim 12 wherein the first, second, and third shingles are installed onto the substrate in a single course.

23. A roofing system comprising:

(a) a first shingle including a central planar portion that (1) is fabricated of sheet material and (2) has a first surface and a second surface opposite the first surface and visually or structurally distinct from the first surface;

(b) a second shingle like the first shingle and with its first surface facing the same direction as the first surface of the first shingle; and (c) a third shingle like the first and second shingles, the third shingle being coupled to the first and second shingles with its first surface facing an opposite direction from the first surfaces of the first and second shingles.

24. The system of claim 23 wherein the central planar portions of the shingles are fabricated of sheet metal.

25. The system of claim 24 herein the central planar portions are fabricated of copper.

26. The system of claim 24 wherein the central planar portion are free of nonmetallic material of substantial thickness.

27. The system of claim 23 herein the first, second, and third shingles lie in a single course of shingles.

28. The system of claim 23 wherein the first and third shingles are coupled to the second shingle such that the central planar portion of the second shingle is separated from the central planar portions of the first and third shingles by a separation distance substantially greater than the thickness of the planar portions.

29. The system of claim 28 wherein the separation distance is at least about five percent of the width of one of the like shingles.

30. The system of claim 28 wherein the separation distance is about one fourth inch.

31. A roofing system for covering a roofing substrate with a plurality of like shingles having opposing first and second planar surfaces that are visually or structurally distinct from each other, the roofing system comprising:

(a) means for suspending a first one of the shingles over the substrate such that its first surface faces away from the substrate;

(b) means for suspending a second one of the shingles over the substrate such that (1) the first and second shingles are fitted together, and (2) the second surface of the second shingle faces away from the substrate; and (c) means for suspending a third one of the shingles over the substrate such that (1) the second and third shingles are coupled together, and (2) the first surface of the third shingle faces away from the substrate.

* * * * *